US006726405B1

(12) United States Patent
Rørheim

(10) Patent No.: US 6,726,405 B1
(45) Date of Patent: Apr. 27, 2004

(54) PORTABLE FLOOD BARRIER AND METHOD OF INSTALLATION

(75) Inventor: Thor Olav Rørheim, Engalsvik (NO)

(73) Assignee: Aquafence AS, Moss (NO)

( * ) Notice: Subject to any disclaimer, the term of this patent is extended or adjusted under 35 U.S.C. 154(b) by 0 days.

(21) Appl. No.: 10/009,825

(22) PCT Filed: Jun. 18, 1999

(86) PCT No.: PCT/NO99/00204

§ 371 (c)(1),
(2), (4) Date: Mar. 5, 2002

(87) PCT Pub. No.: WO00/79062

PCT Pub. Date: Dec. 28, 2000

(51) Int. Cl.[7] ..... E02B 7/20
(52) U.S. Cl. ..... 405/115; 405/107
(58) Field of Search ..... 405/17–19, 90, 405/91, 107, 111, 115, 116, 63; 138/93, 109

(56) References Cited

U.S. PATENT DOCUMENTS 495,788 A * 4/1893 Debarle ..... 405/115
4,096,700 A * 6/1978 Muramatsu et al. ..... 405/63
4,610,794 A * 9/1986 Tsahalis ..... 210/776
4,640,645 A * 2/1987 Simpson et al. ..... 405/63
4,981,392 A 1/1991 Taylor
5,041,919 A * 8/1991 Yamamoto et al. ..... 358/449
5,059,065 A * 10/1991 Doolaege ..... 405/107
5,645,373 A 7/1997 Jenkins
6,481,928 B1 * 11/2002 Doolaege ..... 405/115

FOREIGN PATENT DOCUMENTS

DE 3810493 A * 3/1989
DE 38 10 493 c 2 10/1992
EP 033238 * 8/1981 ..... 405/68
FR 2565271 * 12/1985 ..... 405/111
WO WO 96/27710 9/1996

* cited by examiner

*Primary Examiner*—Jong-Suk (James) Lee
(74) *Attorney, Agent, or Firm*—Christian D. Abel

(57) ABSTRACT

In a method for providing a portable flood barrier (1), flood barrier sections (2, 3, 4) comprising two parallel, spaced apart, inflatable, elongated tubes (5,6 or 5,7) which are joined by a waterproof web (8) are placed on the ground (9) with the side of one of the tubes (6 or 7) facing the flooded area (10), and the other tube (5) facing away from the flooded area (10). Both tubes (5,6 or 5,7) are inflated, and ballast water (13) is filled on the web (8), whereupon, when floodwater (14) rises, the tube (6 or 7) facing the flooded area (10) floats in the floodwater (14) and due to its buoyancy rises, thereby forming a flood barrier (1).

12 Claims, 5 Drawing Sheets

10

PORTABLE FLOOD BARRIER AND METHOD OF INSTALLATION

BACKGROUND

1. Field of Invention

The invention relates to a method for providing a portable flood barrier, in which flood barrier sections comprising two parallel, spaced apart, inflatable, elongated tubes joined by a waterproof web are placed on the ground with the side of one of the tubes facing the flooded area, and the other tube facing away from the flooded area. The invention also relates to a portable flood barrier section comprising two parallel, spaced apart, inflatable, elongated tubes. Further the invention relates to a portable flood barrier system comprising flood barrier sections.

2. Description of Prior Art

Flooding, caused by heavy rain, storms or melted snow, is a problem causing great economical damage and sometimes personal injury. For the purpose of flood control various types of barricades are built.

A well-known type of barricade is the sandbag barricade. This barricade is labour intensive and relatively slow to build. Thus there is a need for a portable barrier which can easily and quickly be erected.

Various types of portable flood barriers are known.

U.S. Pat. No. 4,981,392 describes a water inflatable structural module for constructing temporary dikes and related structures, comprising two identical elongated flattened cylinders which are sealed at opposite lateral ends to form a sealed, watertight chamber within a cylinder. The cylinders are joined by a flexible web. The cylinders can be inflated with water. Several modules may be stacked in an interlocking structure of any desired height without the use of fastening elements.

U.S. 5,645,373 describes a temporary flood control system comprising elongated flexible, inflatable, tubular ballast members secured to each other and adapted to be disposed on the ground for anchoring a generally sheetlike vertically extendable barrier wall or an inflatable tubular barrier member disposed above and connected to the ballast members. The ballast members are at least partly fillable with a dense ballast liquid, such as water, and may be inflated with pressurized air.

SE 503 551 describes a flood barrier comprising at least one water-filled chamber and a web or skirt which is kept in place by the floodwater. A similar construction in which the chamber is filled with air is also known.

De 3 810 493 describes a flood barrier comprising two inflatable hoses of different size, which are joined by a very short web. Both hoses may be partly filled with water. When used as a flood barrier, the larger hose is placed facing the flooded area, while the smaller hose is placed behind the larger hose as a support.

A general problem with these portable flood barriers according to prior art is their lack of resistance against lateral pressure from the flooded area, which may lead to lateral movement of the flood barrier and the subsequent breaking through of water. A further problem, particularly on soft or permeable ground, is water-flow from the flooded area underneath the barrier.

BRIEF SUMMARY OF THE INVENTION

The object of the invention is to provide a method for providing a portable flood barrier, a portable flood barrier section and a flood barrier system comprising portable flood barrier sections which shall be quick and easy to erect, which shall withstand lateral pressure from the flood area, and in which the above mentioned problem of floodwater flowing underneath the barrier shall be reduced.

The objects are achieved by a method for providing a portable flood barrier, a portable flood barrier section and a flood barrier system as mentioned in the preamble, which are characterized by the features of the claims.

The invention relates to a method for providing a portable flood barrier, in which flood barrier sections comprising two parallel, spaced apart, inflatable, elongated tubes joined by a waterproof web are placed on the ground with the side of one of the tubes facing the flooded area, and the other tube facing away from the flooded area. According to the invention both tubes are inflated, and ballast water is filled on the web. This is done in an area in which flooding is expected to take place, preferably prior to the rising of the floodwater. Some water on the ground in which the barrier sections are placed will, however, normally not preclude the use of the invention. When the floodwater rises, the tube facing the flooded area floats in the floodwater and rises due to its buoyancy thereby forming a flood barrier.

The actual barrier is formed by the floating tube facing the flooded area. The method according to the invention thus relates to a principle, in which a physical phenomena created by the floodwater itself contributes to the formation of the barrier.

The barrier section and the flood barrier system according to the invention are favourable in the method for providing the flood barrier.

DESCRIPTION OF THE DRAWINGS

Embodiments of the invention will now be explained with reference to the enclosed drawings, in which.

DETAILED DESCRIPTION OF THE INVENTION

Figure 8:
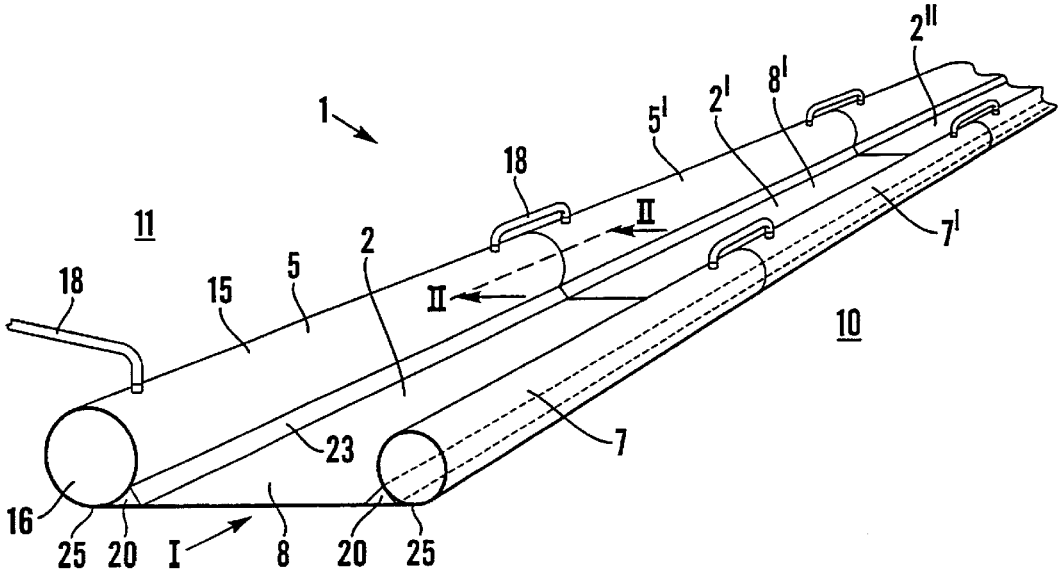
FIG. 8 is a perspective view of a flood barrier according to the invention.

For a brief description of the main principles of the invention, reference is first made to FIG. 8, which illustrates a portable flood barrier 1 according to the invention, which is formed by a number of portable flood barrier sections 2, 2', 2", etc. placed end to end on the ground. Each flood barrier section 2, 2', comprises two parallel, spaced apart, inflatable, elongated tubes 5, 5'; 7, 7' which are joined by a waterproof web 8, 8'. The side of the tubes 7, 7' faces a flooded area 10, and the other tubes 5, 5' faces away from the flooded area, i.e. faces a non-flooded area 11.

FIGS. 1–7 are end views of flood barrier sections, seen in the direction of arrow I in FIG. 8. Ballast water channels 20, which will be discussed later, is however not included in any of the FIGS. 1–7.

Figure 1:
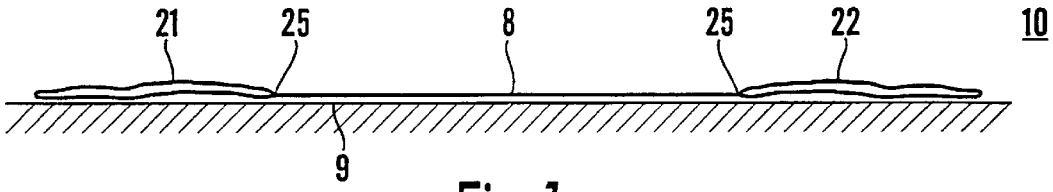
FIG. 1 is an end view of a deflated flood barrier section according to the invention, seen in the direction of arrow I in FIG. 8.

FIG. 1 is an end view of a deflated flood barrier section. The flood barrier section is made from a flexible, air-tight, waterproof fabric, and consists of two flat, hollow, longitudinal portions 21, 22 and the intermediate web 8, which is joined to the hollow sections 21, 22 in joint areas 25. In its deflated condition the flood barrier section can thereby be rolled or folded up to facilitate storage and handling.

When providing the flood barrier, the flood barrier sections are unrolled or unfolded, and placed on the ground 9, as illustrated in FIG. 1, prior to the rising of the floodwater. The hollow section 22 faces an area 10 which is flooded or is expected to be flooded. Preferably the ground 9 is dry when placing the flood barrier sections, some water on the ground is however acceptable. The hollow sections 21, 22 are then inflated.

Figure 2:
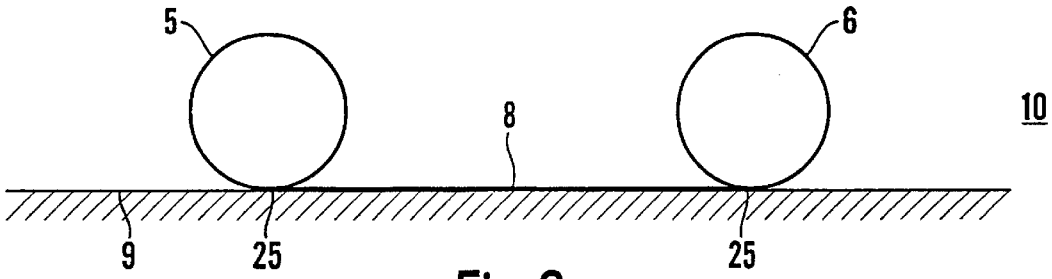
FIGS. 2–4 are end views of the flood barrier section of FIG. 1 in an inflated condition.

FIG. 2 illustrates the flow barrier section of FIG. 1 after inflation of the hollow sections 21, 22, which thereby form tubes 5, 6.

Figure 3:
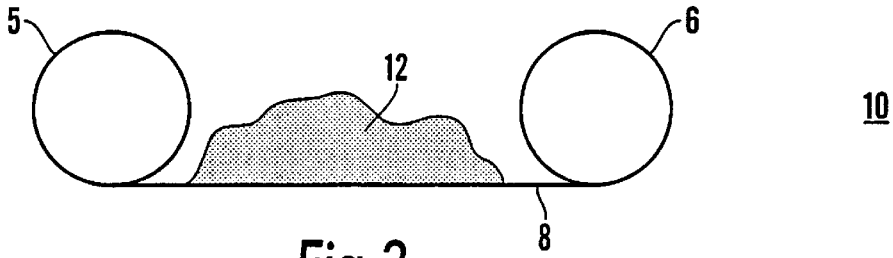

FIG. 3 illustrates an option in which a ballast material in the form of gravel 12 is placed on the web 8 to stabilise the flood barrier section. Alternatively the ballast material may be placed on the web 8 prior to the inflation of the tubes 5,6. Other available ballast material, e.g. sandbags, may also be used.

Figure 4:
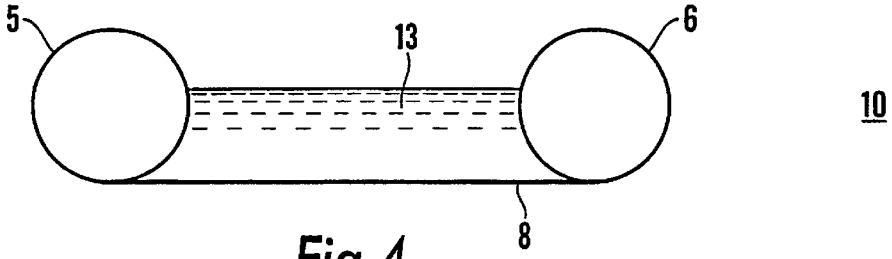

Whether or not the flood barrier section is stabilised with ballast material, ballast water 13 is filled on the web 8, between the tubes 5 and 6, as illustrated in FIG. 4.

Figure 5:
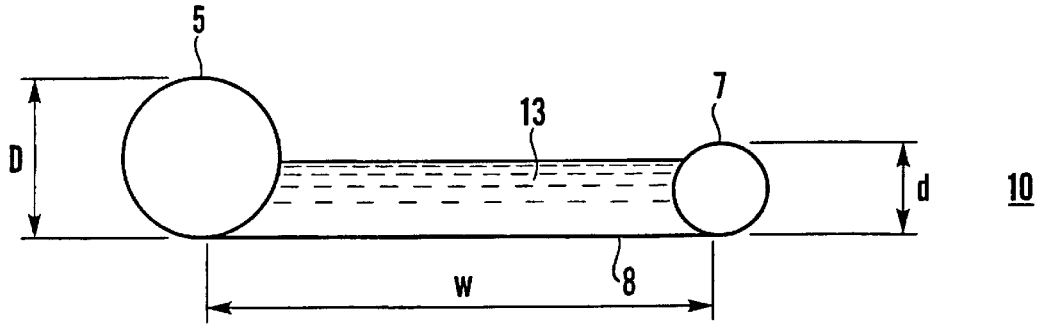
FIGS. 5–7 are end views of another flood barrier section according to the invention in an inflated condition.
Figure 6:
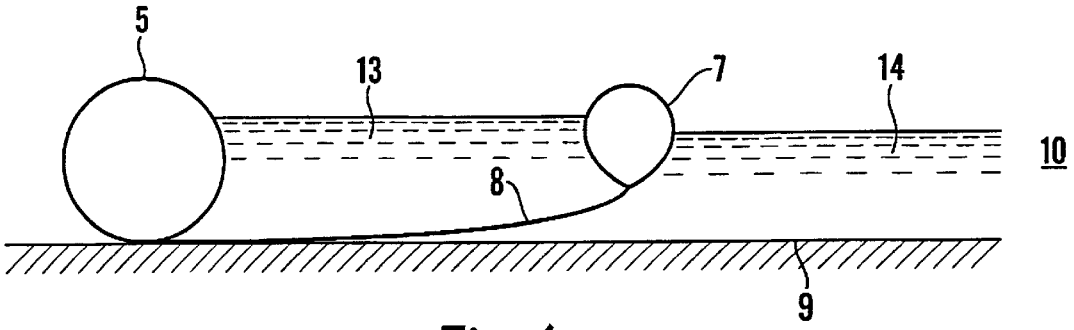
Figure 7:
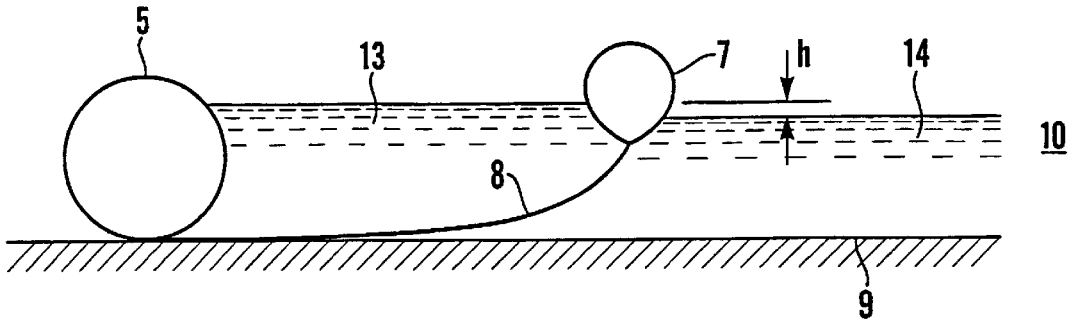

The principle of the invention will now be further explained with reference to a preferred embodiment of the flood barrier section according to the invention, as illustrated in FIGS. 5–7, in which the diameter d of the tube 7 facing the flooded area 10 is smaller than the diameter D of the tube 5 facing away from the flooded area 10. In other aspects the embodiment in FIGS. 5–7 corresponds to the embodiment in FIGS. 1–4.

The inflated tubes are lighter than water, and when the floodwater 14 rises, see FIG. 6, the tube 7 facing the flooded area 10 floats in the floodwater 14. The floodwater 14 is prevented from flowing into the area between the tubes 5,7 by the waterproof web 8, and the tube 7 and the web 8 thereby form a flood barrier. Due to the buoyancy of the tube 7, a further rising of the floodwater 14 leads to a further rising of the tube 7, see FIG. 7. It has been found that when the floodwater 14 rises, the tube 7 drifts towards the tube 5, which leads to an increase in the level of the ballast water 13. It has further been found that the height difference h between the ballast water 13 and the floodwater 14 is always positive, though decreasing, until the level of the ballast water 13 reaches the top of the tube 5, and ballast water starts to overflow the tube 5.

The embodiment which is illustrated in FIGS. 1–4, in which the two tubes of the flood barrier section are of the same size, will function as the embodiment illustrated in FIGS. 5–7. From the point of view of handling, however, a small flood barrier section is preferred, and it has been found that the diameter of the tube 7 facing the flooded area 10 preferably should be between 0.3 and 0.9, more preferred between 0.45 and 0.75 and most preferred approximately 0.6 of the diameter D of the tube 5 facing away from the flooded area 10.

A complete mechanical analysis of the flood barrier is beyond the scope of a patent application. Simplified, the barrier's resistance to lateral movement can be explained as follows:

Lateral forces on the tube 5, trying to move the tube 5 away from the flooded area 10 and thereby removing the barrier, are formed by pressure from the ballast water 13 on the tube 5, which pressure is proportional to the height of the ballast water 13.

When no floodwater is present, the lateral forces on the tube 5 are counteracted by similar lateral forces on the tube 6 or 7, and thus, whether or not there is a friction between the web 8 and the ground 9, there are no resulting force trying to move the barrier in the lateral direction.

When floodwater is present, the lateral forces due to the water pressure on the tube 6 or 7 is much smaller, and the lateral forces on the tube 5 will have to be counteracted by frictional forces between the web 8 and the ground 9. An increased width w of the web 8, see FIG. 5, leads to an increased weight of the ballast water 13, and thus an increased frictional force. An increase of the width w thus increases the barrier's resistance against lateral movement.

From the point of view of handling, however, it is preferred that the width w is small.

Another issue related to the width w of the web 8, particularly on soft or permeable ground, is the under-flow of floodwater 14 underneath the web 8 and the tube 5. This problem is reduced by an increase in the width w, which will lengthen the path for the flow underneath the web 8 and tube 5, and is also reduced by increase in the height of the ballast water, as this compresses the ground.

It has been found that the width w of the web 8 preferably should be between 1 and 5, more preferred between 2 and 4 and most preferred approximately 3 times the diameter of the tube 5 facing away from the flooded area 10.

Figure 9:
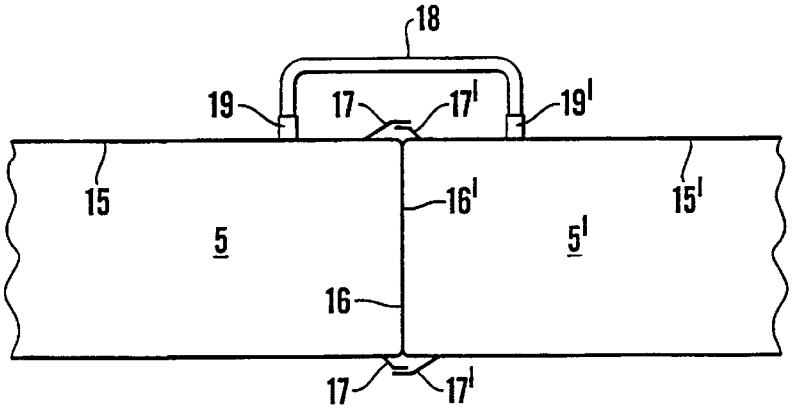
FIG. 9 is a longitudinal section through the flood barrier of FIG. 8, taken along intersecting line II—II.

Reference is again made to FIG. 8, and also FIG. 9, which is a longitudinal section through the flood barrier of FIG. 8, taken along intersecting line II—II.

FIG. 9 illustrates cylindrical walls 15, 15' and end walls 16, 16' of corresponding tubes 5, 5' of adjacent flood barrier sections 2, 2'. In the illustrated embodiment the flood barrier sections 2, 2' are connected end to end by watertight seals, which are accomplished via lips 17, 17' provided in the end portions of the corresponding tubes 5, 5'. During placing of the flood barrier sections on the ground 9, the lips 17, 17' are arranged in an overlapping manner, thereby forming watertight seals. Such seals may be provided both for the tubes 5, 6, 7 and the web 8. In this way, flow of water between the ballast water area between the tubes and external areas is prevented. As explained above, the height or level of the ballast water 13 will normally be higher than the height or level of the floodwater 14, and thus the function of the watertight seals will be to prevent the ballast water from escaping from the area between the tubes.

In order to stabilise the flood barrier sections on the ground, it is preferably that elongated ballast water channels 20 (se FIG. 8) be provided in the joint areas 25 between the elongated tubes 5,6 or 5,7 and the web 8. Corresponding ballast water channels 20 of adjacent tubes may be connected by watertight seals as discussed above, and filled with water prior to the inflation of the tubes in order to stabilise the flood barrier sections.

Inflation may be achieved by inflating each tube separately. FIGS. 8 and 9 does however illustrate a preferred embodiment in which end portions of corresponding tubes, e.g. tube 5, 5', of adjacent flood barrier sections 2, 2' are provided with air conduit connectors 19, 19' and interconnected by air conduits 18 for the transfer of air between the tubes. In this way, only one connection from one of the tubes to a source for pressurized air, e.g. an air compressor, is required. The air pressure is slightly above atmospheric. The air pressure and air flow may be monitored by suitable instrumentation in order to detect air-leakage.

Figure 10:
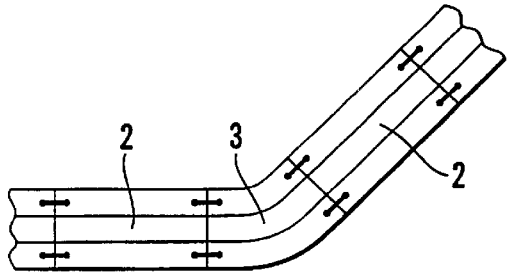
FIGS. 10–11 are plan views of flood barriers including alternative flood barrier sections according to the invention.

FIG. 10 is a plan view of a flood barrier including a flood barrier section 3 which is curved or angled at a 45° angle. In other aspects the flood barrier section 3 corresponds to the straight flood barrier sections 2 discussed above.

Figure 11:
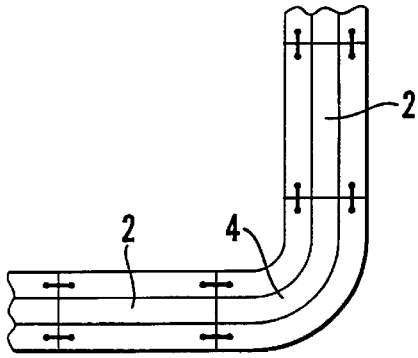

FIG. 11 is a plan view of a flood barrier including a flood barrier section 4 which is angled at a 90° angle. In other aspects the flood barrier section 4 corresponds to the flood barrier sections 2, 3.

Figure 12:
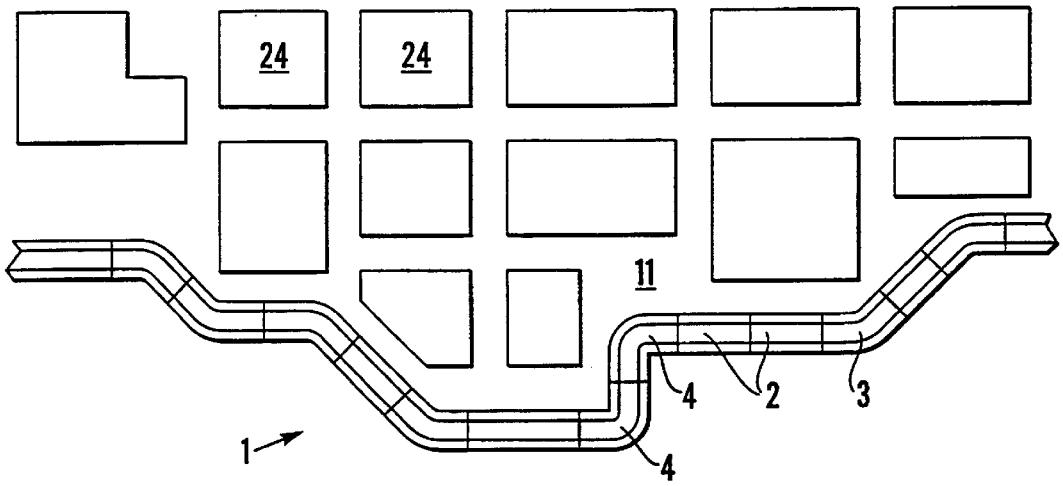
FIG. 12 is a plan view of a flood barrier according to the invention.

FIG. 12 is a plan view of a flood barrier 1 according to the invention, comprising straight flood barrier sections 2 and curved or angled flood barrier sections 3, 4. Reference numerals 24 indicate houses in a non-flooded area 11, and reference numeral 10 indicates the flooded area. By a suitable combination of straight and curved or angled flood barrier sections 2, 3, 4, a straight, curved or angled flood barrier 1 which is adapted to protect the area 11 from the flood may be provided.

The above features of the invention, related to the seals 17, the air conduits 18 and the possibility of combining straight and curved flood barrier sections 2, 3, 4 turn the invention into a portable flood barrier system for the formation of a continuos flood barrier 1.

Figure 13:
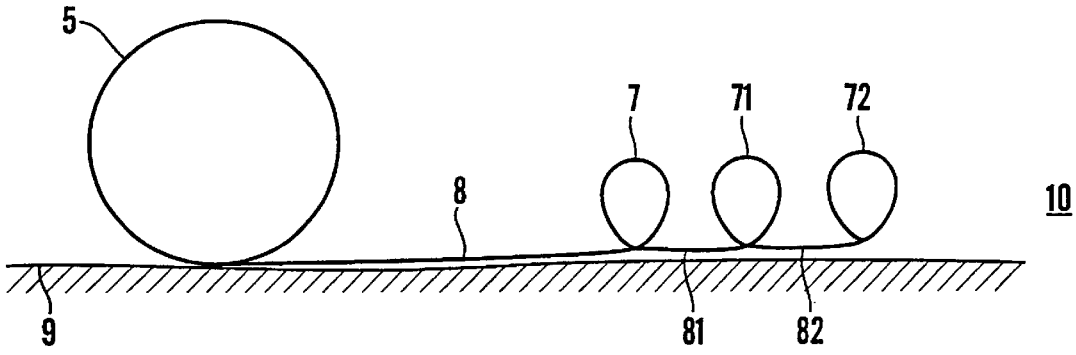
FIGS. 13–14 are end views of another embodiment of the flood barrier section according to the invention in an inflated condition.

FIG. 13 illustrates another embodiment of the flood barrier section according to the invention in an inflated condition, before the flood has risen. In this embodiment the tube 7 facing the flooded area 10 is combined with two additional tubes 71, 72, which are connected to tube 7 via additional web portions 81, 82.

Figure 14:
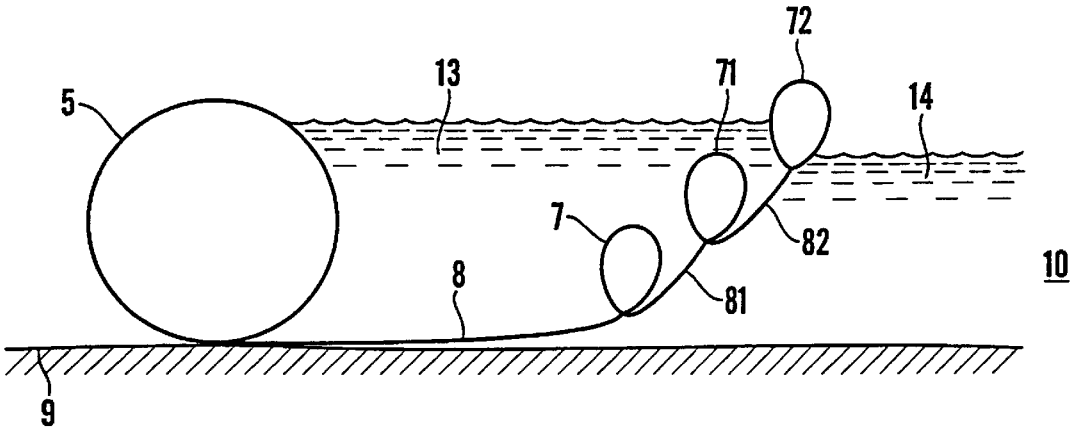

FIG. 14 illustrates the flood barrier section of FIG. 13 after ballast water 13 has been filled on the web 8, 81, 81, and the floodwater 14 has risen. As can be seen from FIG. 14, the tubes 7, 71, 72 form a multiple flood barrier. This multiple flood barrier, in which the web portions 81, 82 are elevated above the ground 9, is more flexible than the single tube 7, and is thus favourable for catching waves and objects in the floodwater. The additional tubes also form stand-by tubes, which maintain the flood barrier's functionality if one of the tubes is punctured.

The additional tubes may have a number of one or more, with the illustrated number of two being a convenient number, taking the above considerations and weight, handling and production costs into consideration.

The flood barrier sections may be produced from a waterproof fabric, such as a polyvinylchloride sheeting, by folding the sides of the fabric and joining the side edges to the fabric in the joint areas 25, thereby providing the cylindrical walls 15 of the tubes. Then the end walls 16, the air conduit connectors 19 and the lip seals 17 are sealingly fitted to the cylindrical walls 15. Such sealingly fitting may be obtained through gluing or welding. The ballast water channels 20 can be produced by sealingly fitting channel web portions 23 in the joint areas 25, the channel web portions 23, the tubes 5, 6 or 7 and the web 8 thereby forming a triangular ballast water channel 20.

Typically a flood barrier section according to the invention is made from a 0.6 mm thick polyester sheet, with a weight of 700g/m$^2$. The diameters D, d of the large and small tubes are typically 1.2 and 0.7 m respectively, and the width w of the web is typically 3.3 m. A typical length of a flood barrier section is 20 m. Such a flood barrier section will have a mass of approximately 200 kg, which means that in a folded or rolled up condition it can easily be transported on a truck, unloaded onto the ground by a portable crane, and unrolled or unfolded by two persons.

During use, ballast water 13 is typically filled to a level of 0.7 m. This level may rise to the top of the largest tube 5, i.e. 1.2 m with the above dimensions, when the floodwater rises.

Thus a method for providing a portable flood barrier, a portable flood barrier section and a flood barrier system comprising portable flood barrier sections which are quick and easy to erect has been provided. The flood barrier withstands lateral pressure from the flood area, and the problem of floodwater flowing underneath the barrier has been reduced.

What is claimed is:

1. A method for providing a portable flood barrier (1), in which flood barrier sections (2, 3, 4) comprising two parallel, spaced apart, inflatable, elongated tubes (5,6 or 5,7) joined by a waterproof web (8) are placed on the ground (9) with the side of one of the tubes (6 or 7) facing the flooded area (10), and the other tube (5) facing away from the flooded area (10), characterized in inflating both of the tubes (5,6 or 5,7), and filling ballast water (13) on the web (8), whereupon, when floodwater (14) rises, the tube (6 or 7) facing the flooded area (10) floats in the floodwater (14) and due to its buoyancy rises, thereby forming a flood barrier (1).

2. A method according to claim 1, characterized by also placing ballast material (12) on the web (8).

3. A method according to claim 1, characterized by connecting a number of flood barrier sections (2, 3, 4) end to end by watertight seals (17) preventing water from flowing between the area between the tubes and external areas.

4. A method according to claim 3, characterized by connecting corresponding tubes (5,5'; 7,7') of adjacent flood barrier sections (2, 2') by air conduits (18) for the transfer of air between the tubes (5,5'; 7,7').

5. A method according to claim 1, wherein the tube (7) facing the flooded area (10) is combined with one or more additional tubes (71, 72) to form a multiple flood barrier.

6. A portable flood barrier section (2,3,4) comprising two parallel, elongated tubes (5,6 or 5,7) for placement on the ground (9) in a configuration in which the side of one of the tubes (6 or 7) faces the flooded area (10) and the other tube (5) faces away from the flooded area (10), wherein the diameter (d) of the tube (7) facing the flooded area (10) being smaller than the diameter (D) of the tube (5) facing away from the flooded area (10) and the tubes are inflatable and spaced Wart but joined b a waterproof web (8), thereby forming a space for filling ballast to set the barrier.

7. A flood barrier section (2, 3, 4) according to claim 6, wherein the diameter of the tube (7) facing the flooded area (10) being between 0.3 and 0.9 times, more preferred between 0.45 and 0.75 times and most preferred approximately 0.6 times the diameter (D) of the tube (5) facing away from the flooded area (10).

8. A flood barrier section (2, 3, 4) according to claim 6 or 7, wherein the width (w) of the web (8) between the tubes (5,6 or 5,7) being between 1 and 5 times, more preferred between 2 and 4 times and most preferred approximately 3 times the diameter of the tube (5) facing away from the flooded area (10).

9. A flood barrier section (2, 3, 4) according to claim 6, wherein elongated ballast water channels (20) are provided in the joint areas (25) between the elongated tubes (5,6 or 5,7) and the web (8).

10. A flood barrier section according to claim 6, wherein the tube (7) facing the flooded area (10) is combined with one or more additional tubes (71, 72) to form a multiple flood barrier.

11. A portable flood barrier system comprising flood barrier sections (2, 3, 4) in which two parallel, spaced apart, inflatable, elongated tubes (5,6 or 5,7) are joined by a waterproof web (8), for placement on the ground (9) with the side of one of the tubes (6 or 7) facing the flooded area (10), and the other tube (5) facing away from the flooded area (10), characterized by the end portions of the flood barrier sections (2) being provided with seals (17) for the overlapping of corresponding seals (17') of adjacent flood barrier sections (2'), for the formation of a continuous flood barrier (1), and wherein the end portions of the adjacent flood barrier sections (2, 2') are interconnected by air conduits (18) for the transfer of air between the tubes (5,5'; 7,7').

12. A flood barrier system according to claim 11, comprising straight flood barrier sections (2) and curved or angled flood barrier sections (3,4), to enable a curved or angled flood barrier (1).

* * * * *